US007771329B2

(12) United States Patent
Dalebout et al.

(10) Patent No.: US 7,771,329 B2
(45) Date of Patent: Aug. 10, 2010

(54) STRENGTH SYSTEM WITH PIVOTING COMPONENTS

(75) Inventors: William T. Dalebout, North Logan, UT (US); Jared R. Willardson, Smithfield, UT (US); Michael Olson, Logan, UT (US)

(73) Assignee: ICON IP, Inc., Logan, UT (US)

( * ) Notice: Subject to any disclaimer, the term of this patent is extended or adjusted under 35 U.S.C. 154(b) by 0 days.

(21) Appl. No.: 11/864,270

(22) Filed: Sep. 28, 2007

(65) Prior Publication Data

US 2009/0062086 A1 Mar. 5, 2009

Related U.S. Application Data

(60) Provisional application No. 60/969,408, filed on Aug. 31, 2007.

(51) Int. Cl.
*A63B 21/062* (2006.01)

(52) U.S. Cl. ..... 482/99; 482/98

(58) Field of Classification Search ..... 482/92–94, 482/97–103, 133, 138, 142, 908
See application file for complete search history.

(56) References Cited

U.S. PATENT DOCUMENTS

| | | | | |
|---|---|---|---|---|
| 2,219,219 | A | 10/1940 | Boger | |
| 4,300,761 | A | 11/1981 | Howard | |
| 4,316,609 | A * | 2/1982 | Silberman | 482/102 |
| 4,369,966 | A * | 1/1983 | Silberman et al. | 482/38 |
| 4,431,181 | A | 2/1984 | Baswell | |
| 4,603,855 | A * | 8/1986 | Sebelle | 482/103 |
| 4,648,481 | A | 3/1987 | Lee | |
| 4,801,139 | A * | 1/1989 | Vanhoutte et al. | 482/112 |
| 4,826,153 | A * | 5/1989 | Schalip | 482/94 |
| 4,898,381 | A * | 2/1990 | Gordon | 482/103 |
| 4,928,961 | A | 5/1990 | Madden | |
| 4,976,428 | A * | 12/1990 | Ghazi | 482/133 |

(Continued)

FOREIGN PATENT DOCUMENTS

| | | |
|---|---|---|
| WO | 2009029706 | 3/2009 |

OTHER PUBLICATIONS

U.S. Appl. No. 11/874,754, filed Oct. 18, 2007, Dalebout et al.

*Primary Examiner*—Fenn C Mathew
*Assistant Examiner*—Andrew M Tecco
(74) *Attorney, Agent, or Firm*—Workman Nydegger

(57) ABSTRACT

The present invention relates to a strength training exercise device that can be packaged in a substantially pre-assembled manner and that can be reoriented between a packaged position and a use position without the use of tools. The strength training device includes a frame, a resistance assembly, at least one exercise station, and a cable and pulley system linking the resistance assembly to the at least one exercise station. The frame includes a base portion having a stability member that can be moved between a packaged position and a use position. Similarly, an exercise station can be moved between a packaged position and a use position to facilitate packaging and shipping of the strength training device in a substantially pre-assembled manner. The cable and pulley system can link the resistance assembly to the at least one exercise station when the strength training device is in the packaged position.

20 Claims, 8 Drawing Sheets

U.S. PATENT DOCUMENTS 5,120,289 A * 6/1992 Yu ..... 482/137
5,221,245 A * 6/1993 Yeh ..... 482/138
5,236,406 A * 8/1993 Webber ..... 482/100
5,242,345 A 9/1993 Mitchell
5,316,534 A 5/1994 Dalebout et al.
5,669,857 A 9/1997 Watterson et al.
5,676,624 A 10/1997 Watterson et al.
5,683,332 A 11/1997 Watterson et al.
5,725,459 A 3/1998 Rexach
5,733,229 A 3/1998 Dalebout et al.
5,755,823 A 5/1998 Cleary
5,899,834 A 5/1999 Dalebout et al.
5,938,574 A * 8/1999 Webber ..... 482/134
5,944,641 A 8/1999 Habing
5,967,948 A 10/1999 Carr
6,394,936 B1 * 5/2002 Voris ..... 482/100
6,447,430 B1 9/2002 Webb et al.
6,471,622 B1 10/2002 Hammer et al.
6,669,609 B2 * 12/2003 Gerschefske et al. ..... 482/123
6,685,601 B1 * 2/2004 Knapp ..... 482/104
6,685,607 B1 * 2/2004 Olson ..... 482/142
6,689,023 B2 * 2/2004 Baumler ..... 482/100
6,830,540 B2 12/2004 Watterson et al.
6,971,975 B2 12/2005 Croft
7,101,326 B2 * 9/2006 Gerschefske et al. ..... 482/129
7,169,093 B2 * 1/2007 Simonson et al. ..... 482/103
7,322,906 B2 * 1/2008 Webber ..... 482/100
7,384,381 B2 * 6/2008 Webber et al. ..... 482/100
2004/0214693 A1 * 10/2004 Piaget et al. ..... 482/52
2005/0003938 A1 1/2005 Henderson
2006/0030462 A1 * 2/2006 Ish ..... 482/99
2006/0035764 A1 * 2/2006 Webber ..... 482/94
2006/0116254 A1 * 6/2006 Webber et al. ..... 482/94
2006/0252612 A1 11/2006 Melcer

* cited by examiner

STRENGTH SYSTEM WITH PIVOTING COMPONENTS

CROSS-REFERENCE TO RELATED APPLICATIONS

This application claims the benefit of U.S. Provisional Application No. 60/969,408, filed Aug. 31, 2007, the content of which is hereby incorporated by reference in its entirety.

BACKGROUND OF THE INVENTION

1. The Field of the Invention

The present invention generally relates to exercise apparatuses. More specifically, the present invention generally relates to strength training exercise apparatuses that can be packaged and shipped in a substantially pre-assembled manner.

2. The Relevant Technology

Strength training systems having one or more exercise stations linked to a resistance assembly have been around for some time. Strength training systems are often large and made of numerous different parts. In order to reduce the cost associated with packaging, storing, and shipping, strength training systems are packaged in an unassembled manner. Packaging strength training systems in an unassembled manner reduces the size of the box required to enclose the system, thus reducing the packaging costs and the amount of storage space required to store the system.

While packaging strength training systems in an unassembled manner provides some benefits as described above, there are however, various drawbacks to packaging and shipping strength training devices is an unassembled manner. For example, when a strength training system is shipped in an unassembled manner to a user, the user must assemble the strength training system. Such assembly can be complicated. Often, strength training systems are shipped with an instructional manual to assist the user is assembling the strength training system. However, even with the aid of an instructional manual, the complications associated with assembling the strength training system are not eliminated.

Additionally, assembling a strength training system often requires the use of various tools. If a user does not have the required tools, assembly of the system could be further complicated or made impossible. To avoid these complications, a user could purchase the required tools, the tools could be included with the strength training system, or the user could hire someone to perform the assembly. However, such accommodations would increase the costs associated with obtaining the strength training system. Additionally, even with the required tools, assembly of the strength training system takes a significant amount of time.

In light of the foregoing limitations, there is a continuing need for exercise apparatuses that overcome the above shortcomings.

BRIEF SUMMARY OF THE INVENTION

In general, embodiments of the invention are concerned with a strength training exercise device that, among other things, has various components that can be selectively moved between a packaged orientation and a use orientation without requiring extensive assembly or the use of tools. Embodiments of the present invention can be packaged in a substantially pre-assembled manner in which the size of the packaging is generally the same size as the packaging of strength training devices that are not pre-assembled. In one embodiment of the invention, a cabling system is linked to a resistance assembly and at least one exercise station when the exercise device is packaged.

In one exemplary embodiment of the invention, a strength training device is provided having a frame, a resistance assembly, and at least one exercise station. The frame includes a base portion for providing stability to the strength training device. The base portion can include at least one stability base member that can be moved, such as rotated, between a packaged position and a use position. In one embodiment, the stability base member can be in the packaged position when it is positioned parallel to a main base member. The stability base member can be in the use position when it is angled away from the main base member. The stability base member can be secured in the use position with the use of a fastener, such as a screw or bolt.

An exemplary embodiment of the present invention provides a strength training device having at least one exercise station coupled to the frame and the resistance assembly. The exercise station can be moved between a packaged position and a use position to facilitate packaging and shipping of the strength training device in a substantially pre-assembled manner without substantially increasing the size of the packaging and the costs associated therewith. For example, in one embodiment, the exercise station is an press arm assembly having a first press arm and a second press arm. First and second press arms are rotatably coupled to the frame such that they can be selectively moved from a packaged position, in which they are positioned adjacent the frame, to a use position in which they are rotated away from the frame such that a user can engage them during exercise.

An exemplary embodiment of the present invention further provides a locking mechanism that substantially prevents undesired movement of an exercise station between the packaged position and the use position. The locking mechanism can include i) a locking member with at least one guide member, and ii) and an end cap having at least one opening adapted to receive the guide member(s). In use, when the guide member(s) are received within the openings of the end cap, the exercise station is locked in the use position and cannot be moved to the packaged position. However, the locking mechanism can be unlocked by withdrawing the guide member(s) from the openings in the cap, thus allowing the exercise station to be moved from the use position to the packaged position. The locking mechanism can also include a biasing member, such as a spring, to bias the locking mechanism toward the locked position.

An exemplary embodiment of the present invention provides a resistance assembly mounted on or coupled to the frame and linked to the exercise station. The resistance assembly can include a cable and pulley system, one or more weight stacks, one or more resilient rods, a rotation-activated resistance device, a resistance mechanism having a pivoting arm and resistance member, or any combination thereof. The present invention allows for the cable and pulley system to link one or more exercise stations to the resistance assembly when the strength training device is in the packaged position and in the use position. The resistance assembly is adapted to provide resistance to a user of the strength training device as the user engages the exercise station. The resistance assembly can also be at least partially enclosed by a shroud. The shroud can be made from a flexible, resilient material such that if an object presses against it, the shroud will slightly deform, but will regain its previous form when the object is removed.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
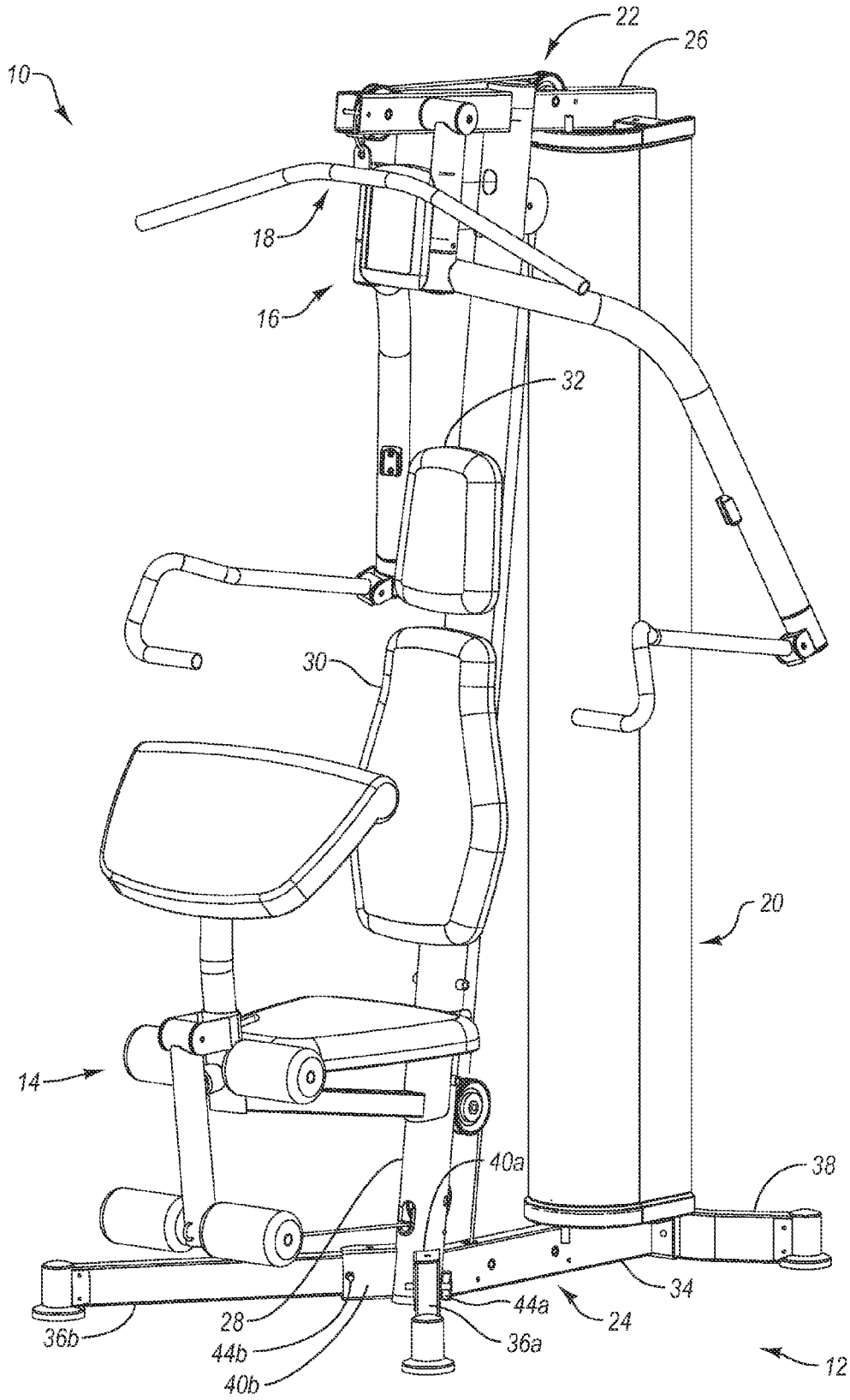
FIG. 1 is a perspective view of an exemplary exercise device of the present invention.

FIG. 1 discloses a strength training system 10 according to one embodiment of the invention. Strength training system 10 is configured to be collapsible, such that strength training system 10 can be packaged and shipped in a pre-assembled manner. Furthermore, strength training system 10 can be packaged in a container having relatively the same size as a typical container for a similarly sized strength training system.

Packaging strength training system 10 in a pre-assembled manner without increasing the container size can provide benefits for the user. For example, the time required to transition strength training system 10 from the container to usable form is reduced. A user is able to remove strength training system 10 from its container and utilize strength training system 10 in less time because strength training system 10 is pre-assembled. Therefore, the assembly stage typically required for strength training systems is removed or otherwise simplified. Likewise, strength training system 10 does not require a larger container, thus maintaining shipping and storage size and cost with similarly sized and shaped strength training systems. In this manner, a user can quickly and efficiently utilize strength training system 10 after removal from its container, without having to pay for additional shipping and storage expense due to an increased container size. In one embodiment, a cable and pulley system can link a resistance assembly to at least one exercise station when the strength training system 10 is in its container, whether for shipping or storage. In this manner, the strength training system 10 can be utilized without substantial assembly after it is removed from its shipping and/or storage container.

Furthermore, the configuration of strength training system 10 enables a user to reorient strength training system 10 from a storage or packaged orientation and substantially secure strength training system 10 in a use orientation without the use of tools. The ability to reorient and secure strength training system 10 in a use orientation, or in other words, an orientation where strength training system 10 is usable for exercise, provides many benefits. For example, a user is able to quickly and efficiently utilize strength training system 10 after it is removed from its container, and user is not required to have or utilize tools to do so. Likewise, a user can quickly and efficiently reorient strength training system 10 for use or for storage without requiring the use of tools. In this manner, tools are not necessitated in order reorient strength training system 10.

Figure 2:
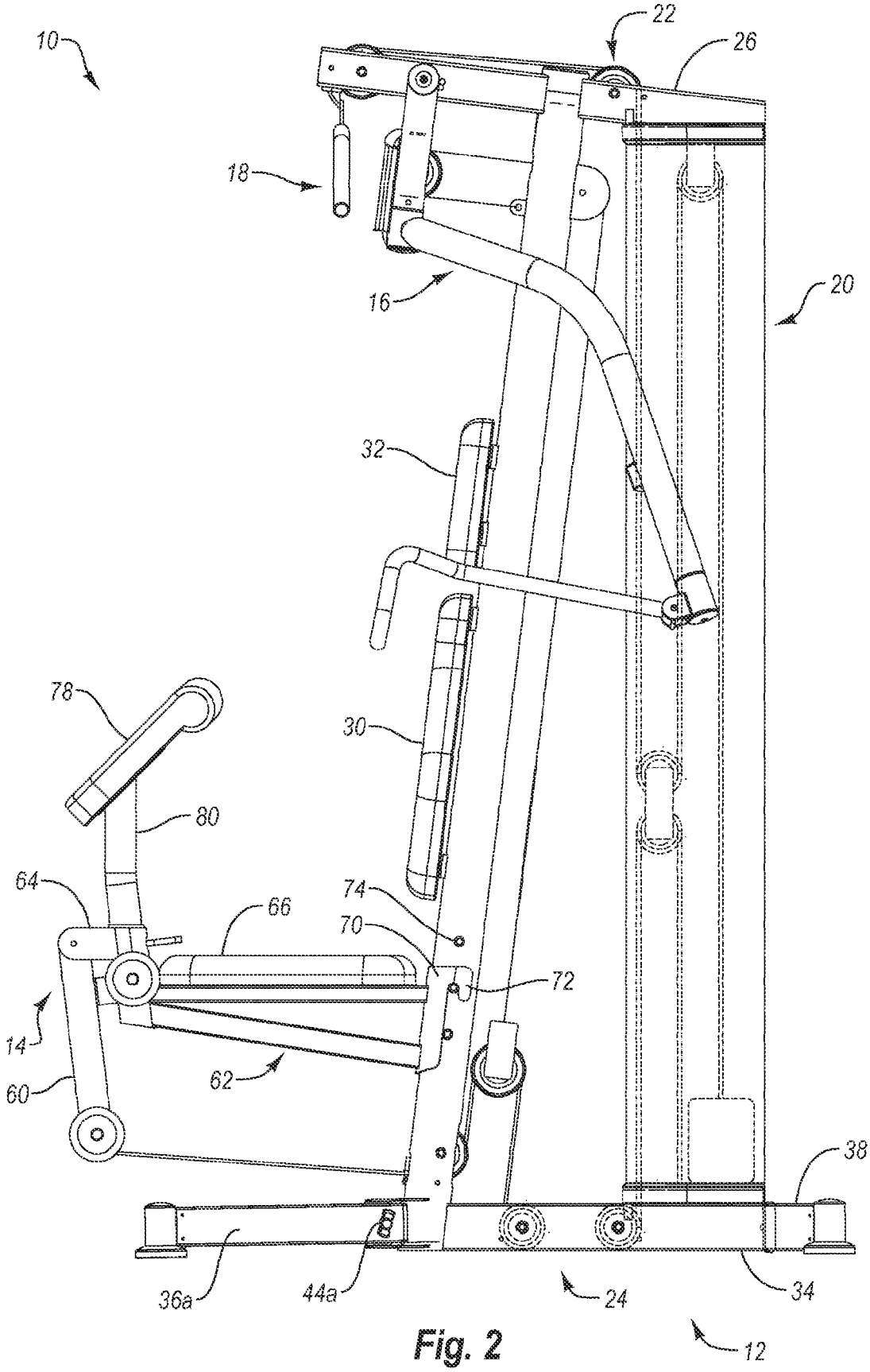
FIG. 2 is a side view of the device of FIG. 1.

With reference now to FIGS. 1 and 2, strength training system 10 can be configured to be collapsible, thereby enabling strength training system 10 to be packaged in a pre-assembled manner without increasing the size of its storage and shipping container. In the illustrated embodiment, strength training system 10 includes a frame 12, at least one and preferably a plurality of exercise stations 14, 16 and/or 18, a resistance assembly 20, and a cable and pulley system 22 linking exercise stations 14, 16 and 18 to resistance assembly 20.

Frame 12 is configured to provide structural support for strength training system 10. Frame 12 can comprise a metal material, such as steel or aluminum, or can comprise some other structural material such as reinforced plastic or composite, or some combination thereof. According to one embodiment of the invention, frame 12 comprises a base 24, an upper member 26, and an upright member 28 coupling upper member 26 to base 24. Base 24 is configured to provide stability to strength training system 10. In the illustrated embodiment, base 24 comprises a main base member 34, a plurality of stability members 36*a*, 36*b* and a rear base member 38.

Main base member 34 can be sized and configured to accommodate portions of cable and pulley system 22 therein, and/or to enable at least a portion of cable and pulley system 28 to link to resistance assembly 20. Main base member 34 can also be sized and configured to provide positioning and support for upright member 28 and resistance assembly 20. For example, upright member 28 is positioned at one end of main base member 34, and at least a portion of resistance assembly 20 is positioned on and supported by the opposite end of main base member 34, as illustrated. In one embodiment, main base member 34 is a steel, hollow rectangular elongate member.

In the illustrated embodiment, stability members 36*a*, 36*b* are pivotally coupled to upright member 28 by brackets 40*a*, 40*b*. Stability members 36*a*, 36*b* are linked to main base member 34 through brackets 40*a*, 40*b* and upright member 28. Stability members 36*a*, 36*b* can be sized and configured to provide stability to strength training system 10 when stability members 36*a*, 36*b* are in a use position, as illustrated in FIG. 1. Stability members 36*a*, 36*b* can be substantially prevented from pivoting by additionally securing stability members 36*a*, 36*b* to brackets 40*a*, 40*b* by use of fasteners 44*a*, 44*b*, respectively. Stability members 36*a*, 36*b* can be positioned at an angle with respect to main base member 34, or can be pivoted toward main base member 34 to be in a storage or packaged orientation, such that stability members 36*a*, 36*b* are substantially parallel to main base member 34. Rear base member 38 can be removably coupled to main base member 34. Rear base member 38 can be sized and configured to provide additional stability to strength training system 10. Base 24 further serves as a support for resistance assembly 20 and upright member 28.

It will be understood by one of ordinary skill in the art in view of the disclosure provided herein that the stability members 36 can be linked to the main base member 34 or upright member 28 by various configurations without departing from the scope and spirit of the invention. For example, in one embodiment, stability members 36 are removably coupled to brackets 40 by a fastener, or in other words can be selectively coupled to and detached from brackets 40 by a pin and lock, a bolt, such as a wing nut, a latch mechanism, or some other type of fastener. In another embodiment, stability members 36 can telescope from main base member 34 and then pivot in order to provide a stabilizing function. In yet another embodiment, stability members 36 can be pivotally linked to upright member 28 so as to be substantially parallel to upright member 28 when in a stored, shipping or otherwise non-use orientation, and then can rotate downward and be secured to provide a stability function.

In the illustrated embodiment, upright member 28 is coupled to base 24 and extends upward from base 24. Upright member 28 is configured to couple various components of strength training system 10 to frame 12. For example, exercise station 14, a back rest 30 and a head rest 32 are removably coupled to upright member 28. Furthermore, various portions of cable and pulley system 22 are coupled to upright member 28 to facilitate linking of exercise stations 14, 16 to resistance assembly 20. Upright member 28 can further comprise a plurality of protrusions 74 configured to facilitate coupling of exercise station 14 to frame 12. In one embodiment, protrusions 74 can comprise a rod positioned through the side walls of upright member 28 such that terminating ends of the rod extend away from upright member 28 in a perpendicular fashion, for example.

In one embodiment, upright member 28 comprises a steel tubular elongate member coupled to main base member 34 via a weld. Brackets 40*a*, 40*b* can also be coupled to upright member 28 via a weld. However, brackets 40*a*, 40*b* and/or main base member 34 can be coupled to upright member 28 by other means. For example, main base member 34 and/or brackets 40*a*, 40*b* can be coupled to upright member 28 by a fastener, such as a bolt or rivet.

According to one embodiment of the invention, upper member 26 is coupled to the upper end of upright member 28 in a similar fashion as brackets 40*a*, 40*b* and/or main base member 34 are coupled to upright member 28. Upper member 26 can comprise a steel, hollow, rectangular elongate member, thus allowing at least a portion of cable and pulley system 22 to be supported and partially housed thereby. For example, at least one pulley of cable and pulley system 22 is rotatably coupled to upper member 22 and at least partially housed therein, as illustrated. Upper member 26 can be in the same vertical plane as main base member 34.

Upper member 26 can be configured to provide support for resistance assembly 20. In the illustrated embodiment, resistance assembly 20 is coupled to one end of upper member 26. With the upper end of resistance assembly 20 coupled to upper member 26 and the lower end of resistance assembly 20 coupled to main base member 34, resistance assembly 20 can be secured relative to frame 12. Furthermore, upper member 26 can provide support to exercise stations 16 and 18. In the illustrated embodiment, exercise station 16 is rotatably coupled to upper member 26 and exercise station 18 is coupled to cable and pulley system 22, a portion of which is rotatably coupled to upper member 26. In this manner, upper member 26 can support exercise station 16 and exercise station 18. Exercise station 16 can be rotatably coupled to upper member 26.

Strength training system 10 can include at least one exercise station, and preferably a plurality of exercise stations 14, 16 and 18. In this embodiment, strength training system 10 includes a leg station designated as 14, such as a leg extension mechanism, an press arm designated as 16, and an arm pull down or lat pull, designated as 18. Leg station 14 can be removably coupled to upright member 28. In this manner, leg station 14 can be selectively attached and detached from upright member 28 at the users convenience.

Figure 5:
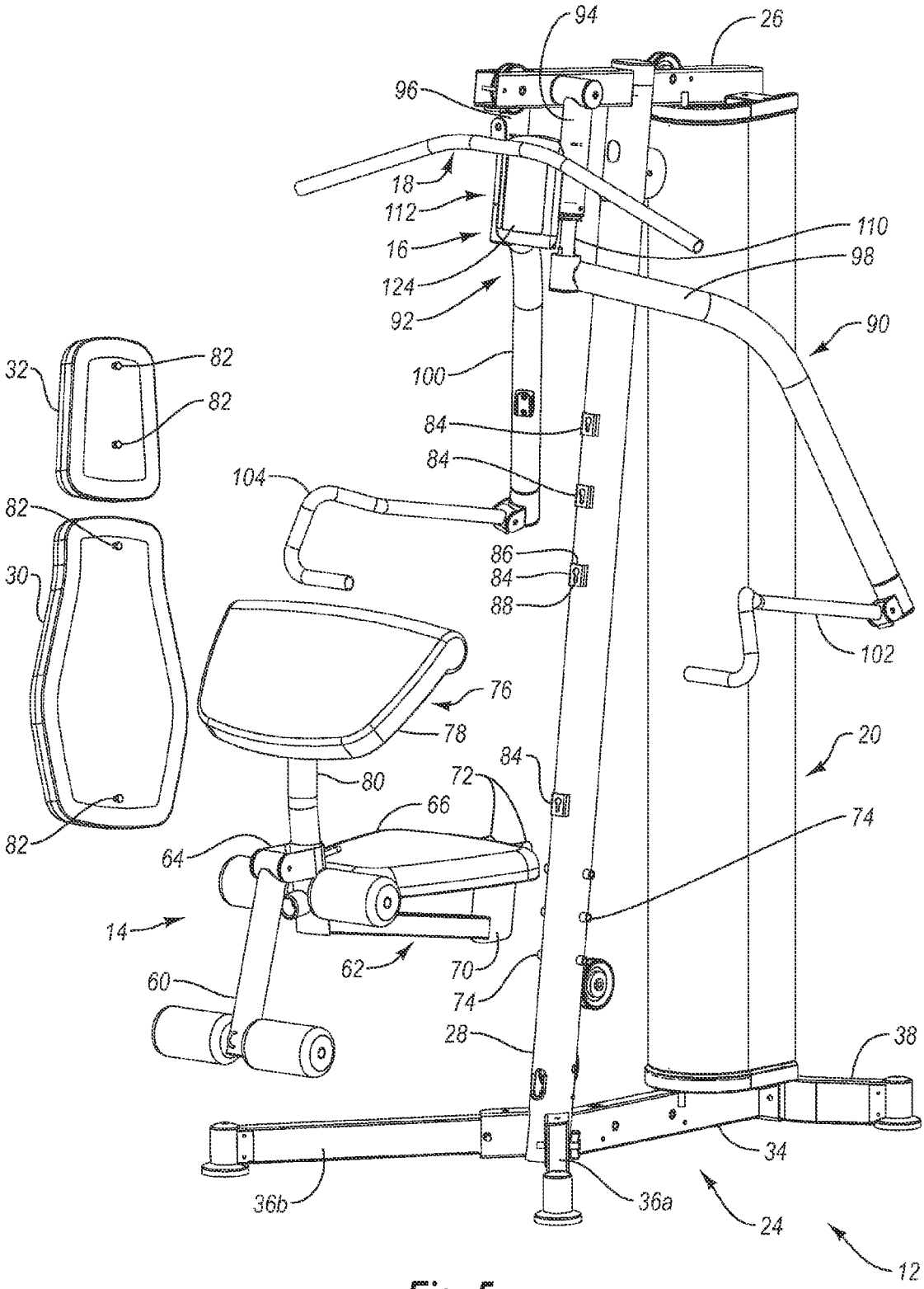
FIG. 5 is a partially exploded perspective view of the device of FIG. 1.

Press arm 16 is rotatably coupled to frame 12. A portion of press arm 16 can be moved downward with respect to upper member 26, as illustrated in FIGS. 5, 7A and 7B, and then rotated toward resistance assembly 20, as illustrated by the arrow in FIG. 6. Rotating press arm 16 toward resistance assembly 20 can position press arm 16 in a storage or packaged orientation. Leg station 14, press arm 16, and arm pull 18 are linked to resistance assembly 20 by cable and pulley system 22 in order to provide resistance for a user during exercise. Arm pull 18 can be linked to cable and pulley system 22 by a clip or removable fastener, thereby enabling a user to quickly connect or disconnect arm pull 18 from the cable of cable and pulley system 22. Through the use of a clip, for example, arm pull 18 can be connected to or disconnected from cable and pulley system 22 without the use of tools, thereby facilitating the quick and efficient utilization of strength training system 10 after removal from a container.

While the illustrated embodiment discloses specific exercise stations, it will be understood in light of the disclosure provided herein that various other exercise stations may be incorporated without departing from the spirit and scope of the invention. For example, other exercise stations can include an arm curl bar, a pull-up bar, an arm cuff or collar, a leg cuff or collar, a butterfly mechanism, a rotating mechanism, a sliding mechanism, a lifting mechanism, a stepper mechanism, or some other mechanism or assembly which can be contacted by a portion of a user's body for purposes of strength training and/or exercise, for example.

Resistance assembly 20 is configured to provide resistance for a user during exercise. In one embodiment, resistance assembly 20 is a weight stack linked to cable and pulley system 22 in an adjustable manner, thereby enabling a user to modify the amount of weight utilized during a given exercise. A variety of different types of resistance assemblies can be utilized with out departing from the spirit and scope of the invention. For example, resistance assembly can include any one of the following or some combination thereof: one or more weight stacks, the resistance mechanism as disclosed in U.S. Pat. No. 6,685,607 entitled EXERCISE DEVICE WITH RESISTANCE MECHANISM HAVING A PIVOTING ARM AND A RESISTANCE MEMBER, the contents of which are hereby incorporated by reference, a rotation-activated resistance device as disclosed in U.S. Pat. No. 5,147,265 entitled ROTATION-ACTIVATED RESISTANCE DEVICE, the contents of which are hereby incorporated by reference, or a mechanism which utilized the weight of the user for resistance.

Resistance assembly 20 is coupled to frame 12 and linked to cable and pulley system 22. Resistance assembly 20 is linked to exercise stations 14, 16 and 18 by cable and pulley system 22. Cable and pulley system 22 comprises at least one cable and a plurality of pulleys. Cable and pulley system 22 is configured to link exercise stations 14, 16 and 18 to resistance assembly. With cable and pulley system 22 being coupled to exercise stations 14, 16 and 18, and exercise stations 14 and 18 being selectively removable, and exercise station 16 being rotatable, strength training system 10 can be packaged in a pre-assembled manner thereby providing many benefits to the user.

Figure 3:
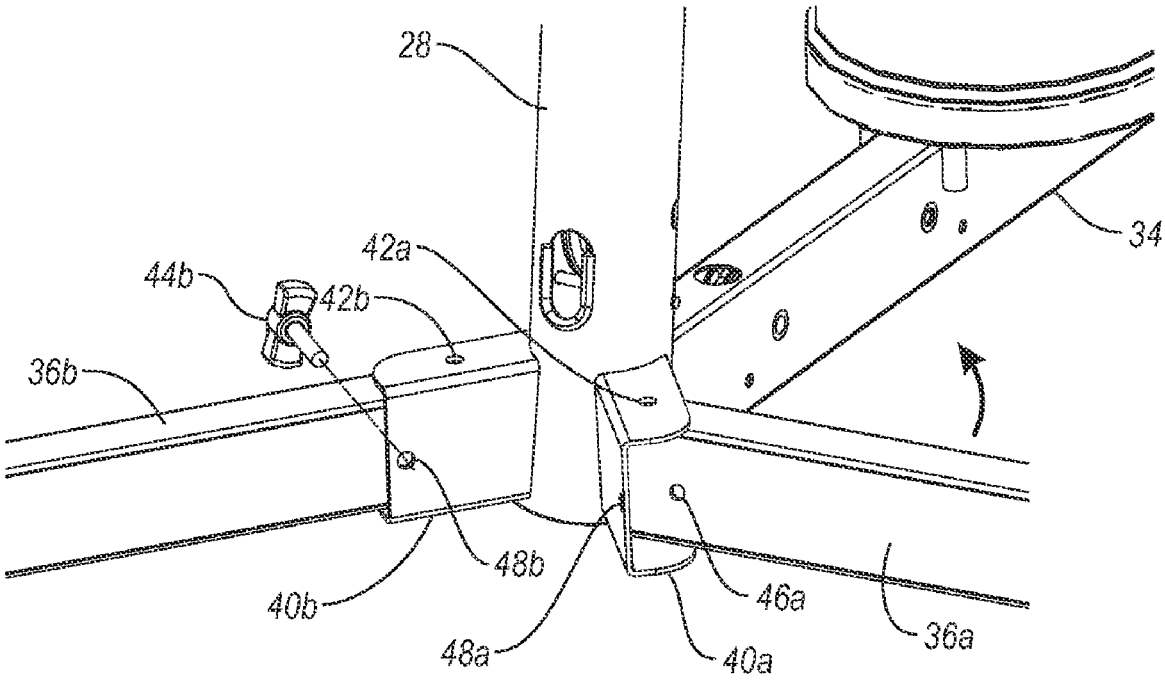
FIG. 3 is a close up perspective view of a portion of the base of the device of FIG. 1.

With reference now to FIG. 3, frame 12 includes stability members 36*a*, 36*b* to facilitate packaging of strength training system 10 in a pre-assembled manner. The ability to package strength training system 10 in a pre-assembled manner enables the user to transition strength training system 10 from its packaged orientation, as illustrated in FIG. 8, to a usable orientation, as illustrated in FIGS. 1 and 2, in a quick and efficient manner. Furthermore, the container used to store and ship strength training system 10 does not need to be substantially increased in order to accommodate for strength training system's pre-assembled state, thereby reducing additional shipping and storage costs associated with larger containers. The cable of cable and pulley system 22 has been suppressed in FIGS. 3-8 to facilitate illustration of other details of strength training system 10.

Figure 4:
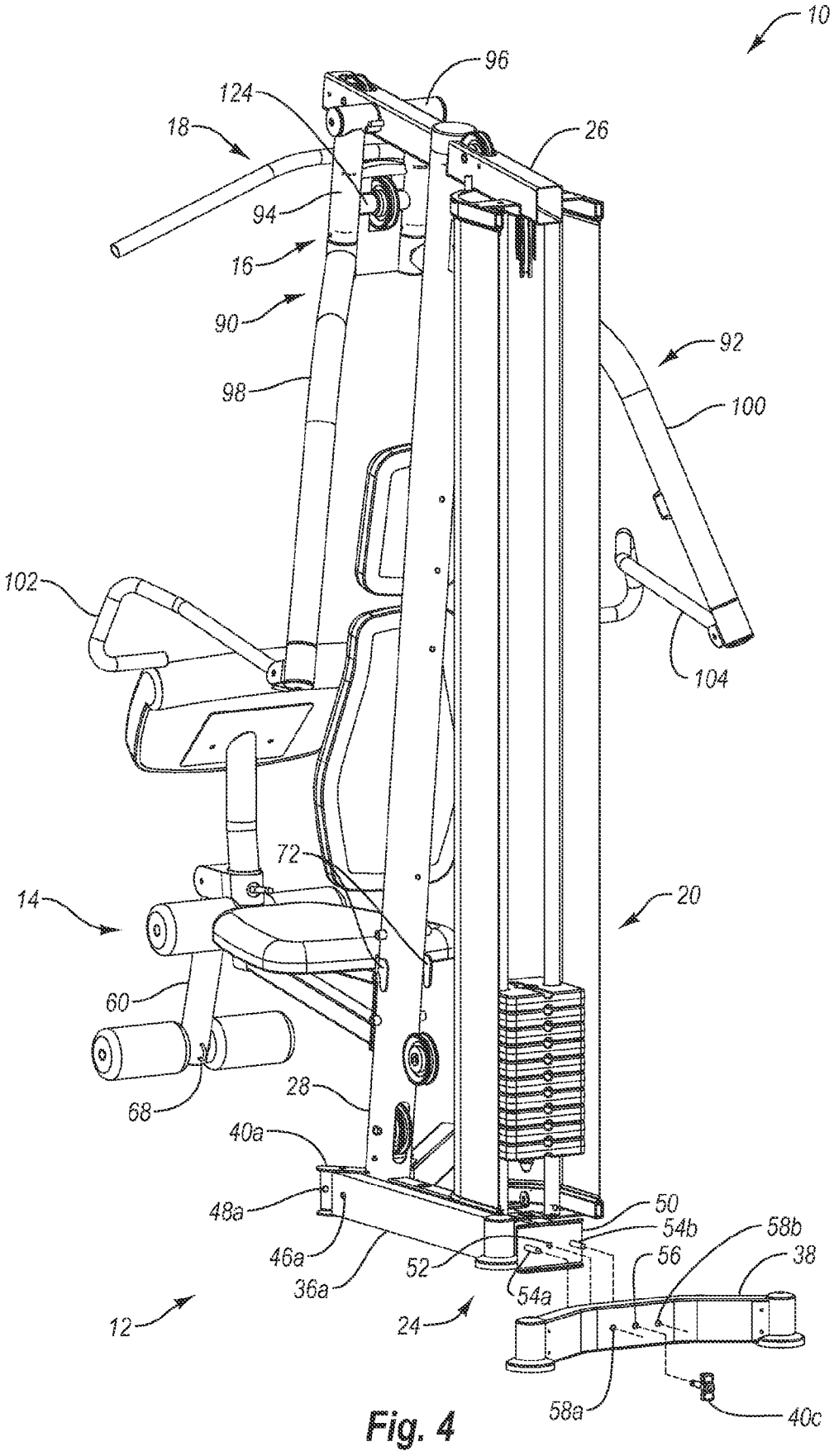
FIG. 4 is an exploded rear perspective view of the device of FIG. 1.

In the illustrated embodiment, stability members 36*a*, 36*b* are pivotally coupled to main base member 34 and upright member 28 by brackets 40*a*, 40*b*. Brackets 40*a*, 40*b* each comprise a pin hole 42*a*, 42*b* on their top and bottom surfaces through which a pin can be positioned in order to secure stability members 36*a*, 36*b* to brackets 40*a*, 40*b*. The pin can be positioned in pin hole 42*a* in the top surface of bracket 40*a*, through stability member 36*a* and then in a corresponding pin hole in the bottom surface of bracket 40*a*. In this manner, stability member 36*a* is able to pivot about pin hole 42*a*. Utilizing a pin positioned in pin holes 42*a* of bracket 40*a* enable pivoting of stability member 36*a*. For example, stability member 36*a* can be rotated in the direction of the arrow so as to be substantially parallel to main base member 34. When stability member 36*a* is pivoted to be substantially parallel to main base member 34, as illustrated in FIG. 4, stability member 36*a* would be considered in its storage or packaged orientation. Brackets 40*a*, 40*b* further comprise an aperture 48*a*, 48*b* for use in substantially securing stability members 36*a*, 36*b* in the use orientation.

Strength training system 10 can further comprise fasteners 44*a*, 44*b*, 44*c*. Stability member 36*a* can be substantially secured in a usable orientation, as illustrated in FIGS. 1 and 2, by use of fastener 44*a*. Stability member 36*a* can include an aperture 46*a* configured to receive and substantially retain fastener 44*a* therein. Fastener 44*a* can comprise a threaded elongate shaft, such as a bolt, which threads can correspond with threads of aperture 46*a* such that fastener 44*a* and aperture 46*a* can engage in a bolt and nut type engagement. For example, in one embodiment, fastener 44*a* comprises a bolt and aperture 46*a* comprises a corresponding nut welded to the inner surface of stability member 36*a*. In the illustrated embodiment, fastener 44*a* comprises a wing-shaped head. Wing-shaped head of fastener 44*a* can be sized and configured to be engaged or gripped by a user thereby enabling a user to twist or rotate fastener 44*a*. Aperture 48*a* can be sized and configured to receive threaded portion of fastener 44*a* therein and prevent wing-shaped head from passing therethrough.

A user can secure stability member 36*a* in the use orientation by pivoting stability member 36*a* until engagement with bracket 40*a* is achieved, as illustrated in FIGS. 1 and 2, inserting threaded portion of fastener 44*a* into aperture 48*a*, and rotating fastener 44*a* to engage aperture 46*a* of stability member 36*a* until wing-shaped head of fastener 44*a* engages or contacts bracket 40*a*. Similarly, to position stability member 36*a* in a storage or packaged orientation, a user can rotate fastener 44*a* in an opposite direction to disengage the threaded portion of fastener 44*a* from aperture 46*a* of stability member 36*a*, remove fastener 44*a* from aperture 48*a* of bracket 40*a*, and then rotate stability member 36*a* toward main base member 34 until stability member 36*a* is positioned against main base member 34, as illustrated in FIG. 4.

While reference has been made specifically to stability member 36*a*, stability member 36*b* can be configured, secured, utilized and oriented in a similar manner as stability member 36*a*, given that in the illustrated embodiment stability member 36*b* is a mirror image of stability member 36*a*. In this manner, a user is able to reorient stability members 36*a*, 36*b* and substantially secure stability members 36*a*, 36*b* in their use orientation absent the use of tools. Likewise, a user is able to reorient stability members 36*a*, 36*b* in the storage or packaged orientation without using tools.

Referring now to FIG. 4, frame 12 further comprises a bracket 50 configured to facilitate securement of rear base member 38 to main base member 34. Bracket 50 can be sized and configured to receive a portion of rear base member 34 therein to facilitate securement and positioning of rear base member 34 with respect to other frame members. In the illustrated embodiment, bracket 50 comprises an aperture 52 and a plurality of guide members 54*a*, 54*b*. Aperture 52 is configured in a similar fashion as apertures 46*a*, 46*b* of stability member 36*a*, 36*b* respectively. Likewise, fastener 40*c* is configured in a similar fashion as fasteners 40*a*, 40*b*. In this manner, aperture 52 and fastener 40*c* can be sized and configured for engagement like a nut and corresponding bolt. Guide members 54*a*, 54*b* are sized and configured to facilitate positioning of rear base member 38.

In the illustrated embodiment, rear base member 38 comprises a plurality of apertures 56, 58*a* and 58*b*. Aperture 56 can be sized and configured in a similar fashion as aperture 48*a* of bracket 40*a*. Apertures 58*a*, 58*b* can be sized and configured to correspond to guide members 54*a*, 54*b*, respectively, such that guide member 54*a* can be received in aperture 58*a* and guide member 54*b* can be received in aperture 58*b*. In this manner, rear base portion 38 can be secured to main base member 34 by positioning guide members 54*a* and 54*b* in apertures 58*a*, 58*b*, respectively, inserting fastener 40*c* in aperture 56 of rear base member 38, and rotating fastener 40*c* so as to engage the threaded portion of fastener 40*c* with aperture 52 until the front face of rear base member 38 engages the rear exposed portion of bracket 50 and wing-shaped portion of fastener 40*c* engages the rear face of rear base member 38.

Further illustrated in FIG. 4 is stability member 36*a* oriented in a storage or packaged orientation. Similar to how stability member 36*a*, 36*b* can be reoriented and secured without using tools, rear base portion can be selectively secured and removable by utilizing fastener 40*c*. The ability to secure rear base portion 38 to main base member 34, and remove or disengage rear base portion 38 therefrom without tools facilitates the quick and efficient utilization by user of strength training system 10 after removal from a container or from a storage orientation.

FIG. 5 illustrates exercise station 14, back rest 30, and head rest 32 being disconnected from frame 12. Exercise station 14, back rest 30, and head rest 32 are configured to be selectively coupled to and selectively removable from frame 12 without the use of tools. In the illustrated embodiment, exercise station 14 comprises a leg extension member 60 pivotally linked to a leg extension frame 62 by a bracket 64 coupled to leg extension frame 62, and a seat 66. The cable of cable and pulley system 22 can extend from an opening in upright member 28, as illustrated in FIG. 1, and couple to leg extension member 60. Cable can be coupled to leg extension member 60 by being fastened to a ring 68 on leg extension member 60. Alternatively, cable can be removably coupled to leg extension member 60 by a clasp or clip, thereby allowing a user to selectively disconnect cable from leg extension member 60, if desired. In this manner, cable and pulley system 22 is configured to link leg extension member 60 to resistance assembly 20 to thereby enable a user to utilize exercise station 14 for exercise and/or strength training.

Leg extension frame 62 is configured to provide support for a user positioned on seat 66. Leg extension frame 62 is further configured to enable exercise station 14 to be selectively coupled to or detached from frame 12 without the use of tools. For example, leg extension frame 62 can comprise a mating member 70 configured to correspond to and mate with the surface of upright member 28, as illustrated in FIGS. 1-2 and 4. Leg extension frame 62 can further include engagement members 72 configured to engage protrusions 74 of upright member 28, as illustrated in FIGS. 2 and 4. With engagement members 72 engaging protrusions 74, and mating member 70 engaging and mating with upright member 28, as illustrated in FIGS. 2 and 4, a user can be positioned on seat 66 and thereby supported by frame 12.

The configuration of and connectivity between leg extension frame 62 and protrusions 74 of upright member 28 enable a user to removably couple exercise station 14 to frame 12 without the use of tools. Likewise, the removable coupling of exercise station 14 to frame 12 facilitates the quick and efficient reorientation of strength training system 10 between a use orientation and a storage or packaged orientation. For example, the configuration of exercise station 14 and upright member 28 enables a user to couple exercise station 14 to frame 12 for use in exercise in a quick and efficient manner without the use of tools. Alternatively, exercise station 14 can be detached from frame 12 without utilizing tools. Exercise station 14 is detached from frame 12 by moving leg extension frame 62 upward to disengage engagement members 72 from protrusions 74. Thereafter, mating surface 70 can be moved away from upright member 28 thereby disconnecting or detaching exercise station 14 from frame 12.

When exercise station 14 is disconnected from frame 12, as illustrated in FIG. 5, seat 66 and leg extension frame 62 can be rotated vertically, for example, to be substantially in line with leg extension member 60, and exercise station 14 positioned proximate upright member 28 for storage or packaging, as illustrated in FIG. 8. In this manner, leg extension member 60 can remain coupled to cable and pulley system 22 while packaged in a container, thereby, at least in part, facilitating the pre-assembled nature of the strength training system 10.

Strength training system 10 can further comprise an exercise station 76 removably coupled to leg extension frame 62. In the illustrated embodiment, exercise station 76 is not coupled or linked to cable and pulley system 22. Rather, exercise station 76 can be used as a support for exercises. For example, exercise station 76 can be an arm support for an exercise known as the preacher curl. Exercise station 76 can comprise a cushioned support member 78 and an elongate support member 80 coupling cushioned support member 78 to leg extension frame 62.

Elongate support member 80 can be sized and configured to be received into a corresponding opening in leg extension frame 62 adjacent bracket 64, thereby enabling exercise station 76 to be selectively removable. In this manner, exercise station 76 can be moved upward with respect to leg extension frame 62 to remove elongate support member 80 from the opening in leg extension frame 62. Likewise, exercise station 76 can be coupled to leg extension frame 62 by aligning elongate support member 80 with opening of leg extension frame 62 and moving elongate support member 80 downward, for example, to position elongate support member 80 in opening of leg extension frame 62. Exercise station 14 links exercise station 76 to frame 12 of strength training system 10. In this manner, exercise station 76 can be selectively connected or linked to frame 12 or disconnected from frame 12 and/or exercise station 14 without the use of tools.

In the illustrated embodiment, back rest 30 and head rest 32 can be removably coupled to upright member 28. Back rest 30 and head rest 32 each comprise fastening members 82 configured to facilitate coupling of back rest 30 and head rest 32 to frame 12. In one embodiment, fastening member 82 comprises a cylindrical shaft and a head connected to a terminating end of shaft, wherein the head has a larger diameter than the cylindrical shaft. Upright member 28 further comprises receiving members 84 configured to receive and substantially secure fastening members 82 therein. In the illustrated embodiment, receiving members 84 comprise a head receiving portion 86 and a slot 88. Head receiving portion 86 is sized and configured to allow head and shaft portion of fastening member 82 therein. Slot 88 is sized and configured to allow shaft portion of fastening member 82 therein, while having a width less than the diameter of the head of fastening member 82 to thereby substantially prevent head portion of fastening member 82 to pull through slot 88. In this manner, as head of fastening member 82 is positioned in head receiving portion 86, fastening member 82 can be moved downward to position head portion adjacent slot 88 and thereby substantially securing fastening member 82 to receiving member 84.

The position of fastening members 82 on back rest 30 can correspond with positioning of receiving members 84 on upright member 28. Likewise, the position of fastening members 82 on head rest 32 can correspond with other receiving members 84 on upright member 28. In this manner, a user can quickly and efficiently couple back rest 30 and head rest 32 to frame 12 without the use of tools. Likewise, a user can quickly and efficiently detach back rest 30 and/or head rest 32 from frame 12 without the use of tools. In the illustrated embodiment, back rest 30 and head rest 32 each comprise two fastening members 82. Upright member 28 can comprise four receiving members 84, two of which correspond with fastening members of back rest 30 and the other two receiving members 84 can correspond with fastening members of head rest 32. In a packaged or storage orientation, back rest 30 and head rest 32 may be disconnected from frame 12.

To connect back rest 30 to frame 12, a user aligns the head portions of fastening members 82 with head receiving portions 86 of the corresponding receiving members 84, positions head portion of fastening member 82 in or through head receiving portion 86 and then slides back rest 30 down until shaft portion of fastening member 82 contacts the bottom portion of slot 88. To disconnect back rest 30 from frame 12, a user moves back rest 30 up or in the direction of head receiving portion 86 until head portion of fastening member 82 is able to be removed through head receiving portion 86 of receiving member 84. Head rest 32 can be coupled to and disconnected from frame 12 in a manner similar to that described with respect to back rest 30. In this manner, a user can couple or disconnect back rest 30 and/or head rest 32 from frame 12 in a quick and efficient manner without the use of tools.

Exercise station 16 is configured to be linked to cable and pulley system 22 to enable a user to utilize exercise station 16 for exercise. In the illustrated embodiment, exercise station 16 comprises a first press arm assembly 90 and a second press arm assembly 92. First and second press arm assemblies 90, 92 each comprise a press arm support member 94, 96 rotatably coupled to upper member 26, a press arm 98, 100 linked to press arm support member 94, 96, and an extension arm 102, 104 rotatably coupled to press arm 98, 100, respectively.

Exercise station 16 is further configured to be movable between a use orientation and a storage or packaged orientation without the use of tools. In the use orientation, exercise station 16 can be utilized by a user for exercise. In the storage or packaged orientation, a portion of exercise station 16 is rotated to be positioned proximate to upright member 28 and resistance assembly 20. To rotate exercise station 16 between the use and storage or packaged orientation, press arm 98 is moved downward with respect to press arm support member 94 so as to disengage a locking feature thereby enabling press arm 98 to rotate relative to press arm support member 94. In one embodiment of the invention, first press arm assembly 90 is substantially the same as second press arm assembly 92, except that first press arm assembly 90 is the mirror image of second press arm assembly 92. As such, it should be understood that details discussed with respect to first press arm assembly 90 can be applied to second press arm assembly 92.

Figure 6:
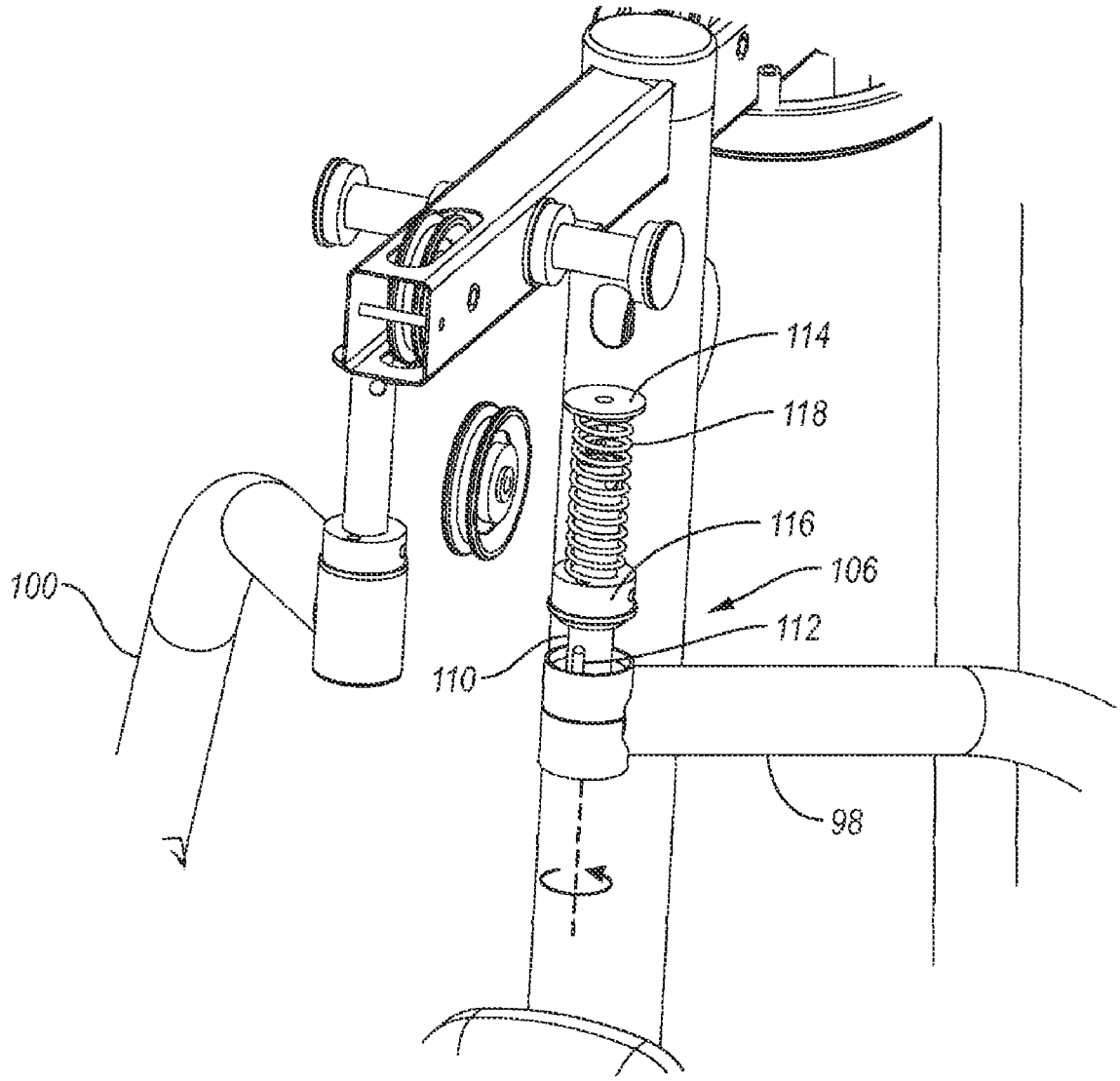
FIG. 6 is an exploded view of a locking mechanism associated with an exercise station of the device of FIG. 1.
Figure 7A:
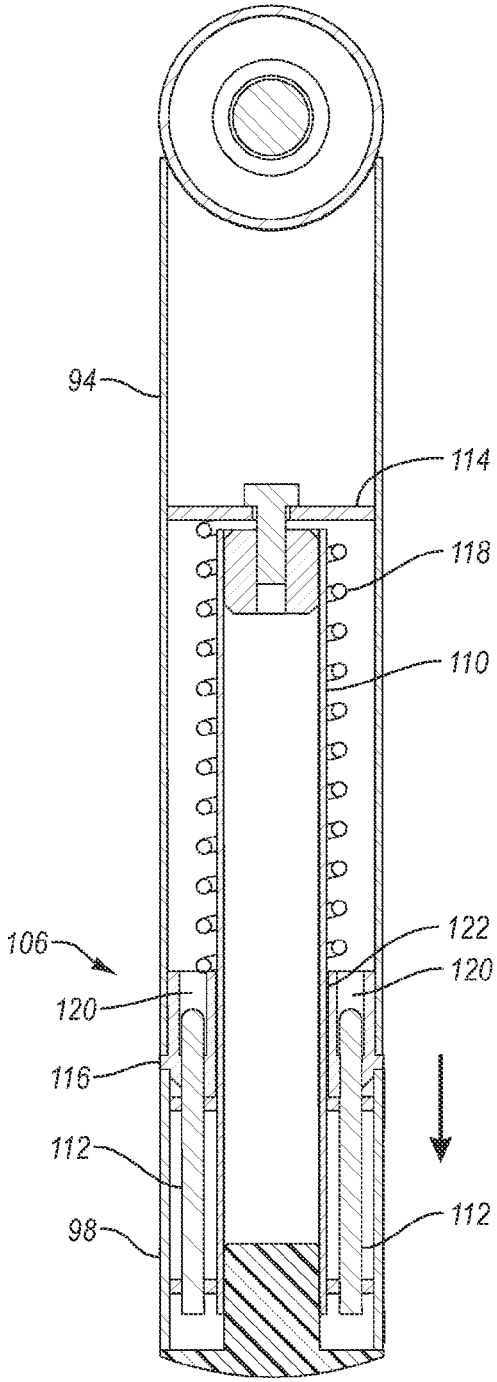
FIG. 7A is a cross-sectional view of the locking mechanism of the device of FIG. 1, wherein the locking mechanism is engaged.
Figure 7B:
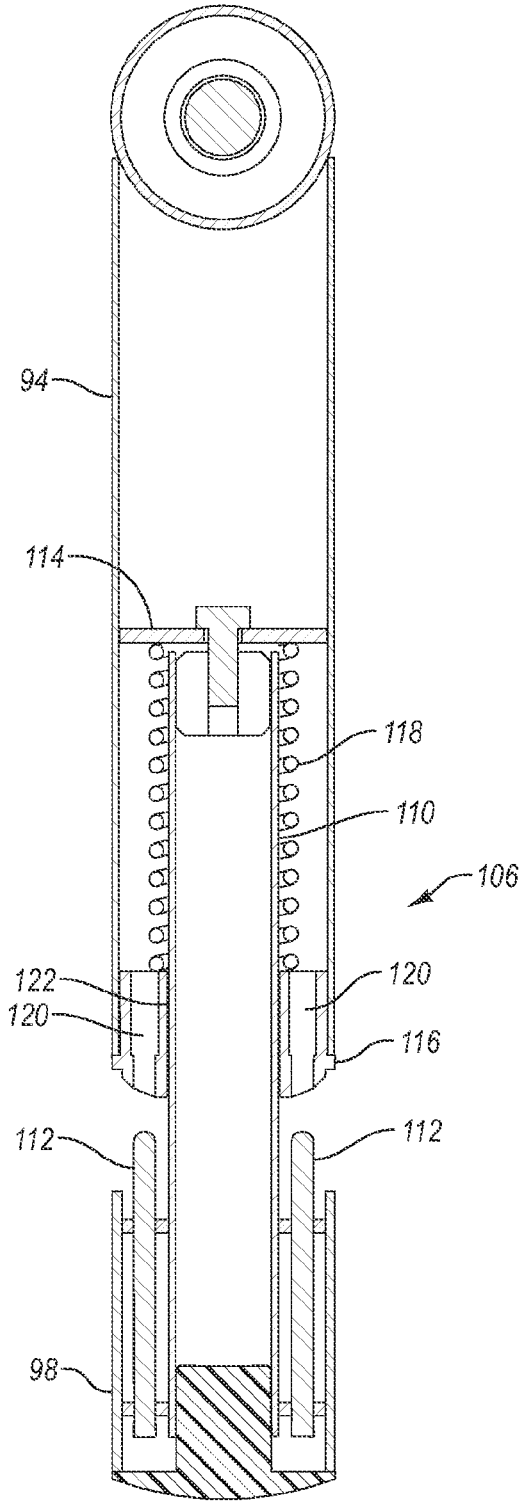
FIG. 7B is a cross-sectional view of the locking mechanism of the device of FIG. 1, wherein the locking mechanism is disengaged.
Figure 8:
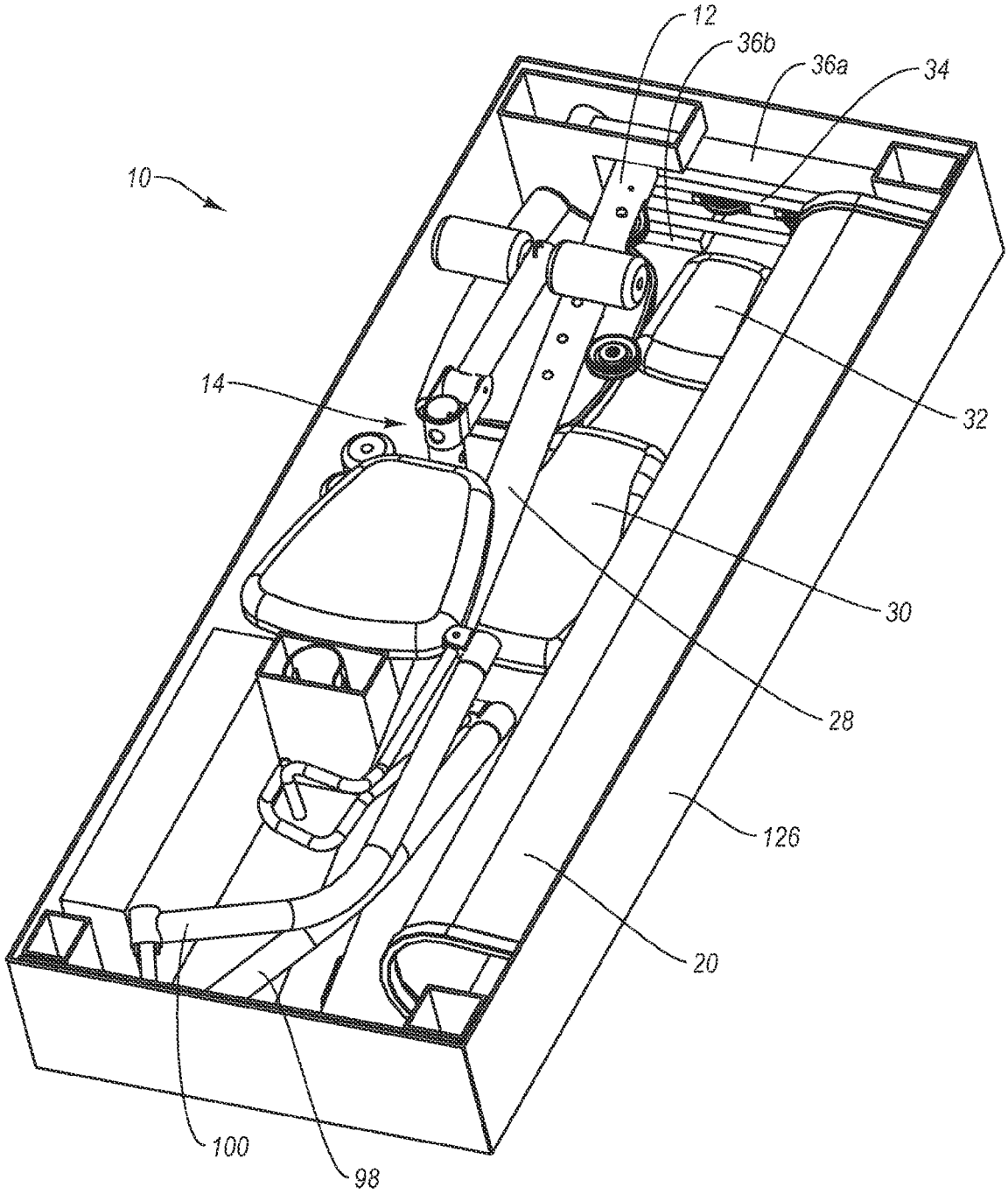
FIG. 8 illustrates the device of FIG. 1 in a collapsed orientation and disposed within a box for storage or shipping.

With reference now to FIGS. 6, 7A and 7B, first and second press arm assemblies 90, 92 each comprise a locking assembly 106, 108 respectively, configured to bias press arms 98, 100 in a use orientation. FIG. 6 illustrates components of first press arm assembly 90 and first locking assembly 106, but portions of first and second press arm support member 94, 96 have been removed to expose and illustrate locking assembly 106, 108. Furthermore, as will be discussed in more detail, portions of locking assembly 108 have been removed to illustrate portions of locking assembly 108, which can be identical to locking assembly 106.

Reference will now be made specifically to details of first press arm assembly 90. However, it should be understood that second press arm assembly 92 is identical to first press arm assembly 90, except that second press arm assembly 92 is a mirror image of first press arm assembly 90. Thus, reference to and details about first press arm assembly 90 and components associated thereto could be applied to second press arm assembly 92 and components associated thereto.

Locking assembly 106 is configured to bias first press arm assembly 90 in a use orientation. Locking assembly 106 is further configured to enable a user to reorient first press arm 98 between a use orientation and a storage or packaged orientation without the use of tools. In the illustrated embodiment, locking assembly 106 comprises a locking member 110 having one or more guide members 112, a cap 114 coupled to one end of locking member 110, an end cap 116 having one or more openings 120 configured to receive a guide member 112 therein, and a biasing member 118 positioned between cap 114 and end cap 116.

Locking member 110 is sized and configured to facilitate locking of press arm 98 so as to substantially prevent rotation of press arm 98 with respect to press arm support member 94 when guide member 112 is received in opening 120 of end cap 116, as illustrated in FIG. 7A. Locking member 110 can be a cylindrical elongate shaft coupled at one end to press arm 98 and coupled to cap 114 on the opposing end. Guide members 112 can be sized and configured to be received in openings 120 of end cap 116 so as to correspond thereto. Guide members 112 can be a cylindrical elongate shaft having a diameter that corresponds with openings 120. Openings 120 of end cap 116 can be sized and configured to correspond to guide members 112 so as to be capable of receiving guide members 112 therein. When guide member 112 is received in opening 120, such as illustrated in FIG. 7A, press arm 98 is substantially prevented from rotating with respect to press arm support member 94.

In the illustrated embodiment, end cap 116 further comprises an aperture 122 sized and configured to enable locking member 110 to be positioned and movable therein. In this manner, locking member 110 links press arm 98 to press arm support member 94. Furthermore, locking member 110 comprises cap 114 coupled to one end of locking member 110. Cap 114 can be sized and configured to facilitate biasing of press arm 98 in the use orientation, and substantially resist locking member 110 from pulling through aperture 122. Cap 114 can further be sized and configured so as to correspond with press arm support member 94 thereby enabling cap 114 and ultimately locking member 110 to be movable inside of press arm support member 94, as illustrated by FIGS. 7A and 7B.

Biasing member 118 is configured to bias press arm 98 in a locked orientation, as illustrated in FIGS. 1-2, 4 and 7A. In one embodiment of the invention, biasing member 118 comprises a spring positioned between and engage cap 114 and end cap 116. The position and engagement of biasing member 118 with respect to cap 114 and end cap 116 enables biasing member 118 to provide resistance to press arm 98 moving away from press arm support member 94. For example, biasing member 118 resists movement of press arm 98 away from press arm support member 94.

As press arm 98 is moved downward, or in the direction of the arrow, biasing member 118 is compressed thereby providing resistance to such movement. Thus, as press arm 98 is moved from a locked orientation, as illustrated in FIGS. 1-2, 4 and 7, to an unlocked orientation, as illustrated in FIGS. 5 and 7B, biasing member 118 is compressed and thereby resists such movement. In this manner, biasing member 118 functions to bias press arm 98 in a locked orientation. Likewise, the configuration of biasing member 118 enables a user to unlock press arm 98 by moving press arm 98 in the direction indicated by the arrow in FIG. 7A. Unlocking press arm 98, as illustrated in FIGS. 5 and 7B, enables a user to rotate press arm 98 relative to press arm support member 94 to reorient press arm 98 between a use orientation and a storage or packaged orientation. In this manner, a user is able to reorient exercise station 16 from a packaged orientation, such as when strength training system 10 is pre-assembled in a packaging and shipping container, to a use orientation in a quick and efficient manner, and without the use of tools.

Exercise station 16 can further comprise a coupling member 124 configured to couple press arm 98 to press arm 100. Coupling member 124 can also be configured to link cable and pulley system 22 to exercise station 16. In this manner, a user can utilize exercise station 16 for exercise when linked to resistance assembly 20 by cable and pulley system 22. First and second extension arms 102, 104 are pivotally coupled to press arms 98, 100 respectively. First and second extension arms 102, 104 are configured to be engaged by a user to move press arms 98, 100. First and second extension arms 102, 104 can be pivoted so as to be positioned proximate press arms 98, 100 respectively, to facilitate packaging of strength training system 10.

In light of the disclosure provided herein, strength training system 10 can be packaged and shipped in a container in a pre-assembled manner. FIG. 8 illustrates strength training system 10 in a packaged orientation inside a container 126. As illustrated in FIG. 8, frame 12 can be packaged in container 126 when stability members 36*a*, 36*b* are positioned against main base member 34, and rear base member 38 is disconnected from main base member 34. Furthermore, with frame 12 oriented in this manner, strength training system 10 can be packaged in container 126 when back rest 30, head rest 32, and exercise station 14 are detached from upright member 28, and when press arms 98, 100 are rotated toward upright member 28 and resistance assembly 20.

Strength training system 10 can be reoriented from a use position to the packaged position as shown in FIG. 8 easily and with minimal effort. Furthermore, not tools are required to accomplish this reorientation. In order to accomplish the reorientation from a use position to the packaged position shown in FIG. 8, back rest 30, head rest 32, and exercise station 14 are detached from upright member 28. As described above, back rest 30 and head rest 32 can be easily removed from upright member 28. In the exemplary embodiments described above, back rest 30 and head rest 32 each have fastening members 32 that are slidably coupled to receiving members 84 on upright member 28. Back rest 30 and head rest 32 can be detached from upright member 28 by sliding fastening members 82 out of receiving members 84. Back rest 30 and head rest 32 are ready to be packaged when they are detached from upright member 28.

Exercise station 14 can be detached from upright member 28 and packaged within container 126 in a similar manner as back rest 30 and head rest 32. Specifically, engagement members 72 of exercise station 14 can be detached from protrusions 74 of upright member 28 by exercise station in an upward manner. Thereafter, exercise station can be moved away from upright member 28. With exercise station detached from upright member 28, seat 66 and leg extension frame 62 can be rotated to be substantially in line with leg extension member 60. Exercise station 14 can remain linked to resistance assembly 20 through cable and pulley system 22. Alternatively, the cable from cable and pulley system 22 can be detached from exercise station 14. With exercise 14 detached from upright member 28, exercise station 14 is ready to be packaged in container 126.

Exercise station 16 can be reoriented from the use position shown in FIG. 1 to the packaged position shown in FIG. 8. As described above, exercise station 16 comprises first extension arm 98 and second extension arm 100 that are rotatably coupled to frame 12 through first and second press arm support members 94, 96. Each of first and second press arm support members 94, 96 have locking member 110 therein. To reorient exercise station 16 to the packaged position, each of first extension arm 98 and second extension arm 100 are pulled in a downward direction to disengage locking member 110. With locking member 110 disengaged, first and second extension arms 98, 100 can be rotated toward frame 12 until they are positioned in the packaged position shown in FIG. 8.

Base member 24 can be reoriented for packaging by pivoting stability members 36*a, b* from the use position shown in FIG. 1 to the packaged position in FIG. 4. Stability members 36*a, b* are typically secured in the use position with fasteners 44*a, b* extending through stability members 36*a, b* and brackets 40*a, b*. Therefore, to reorient stability members 36*a, b*, fasteners 44*a, b* are withdrawn from brackets 40*a, b* and stability members 36*a, b*, thereby allowing stability members 36*a, b* to rotate from the use position to the packaged position.

With back rest 30, head rest 32, and exercise station 14 detached from frame 12, and exercise station 16 and stability members 36*a, b* reoriented to the packaged position, frame 12, including base 24, and exercise station 16 can be placed in container 126 as shown in FIG. 8. Back rest 30 and head rest 32 be placed in the bottom of container 126 under upright member 28. Further, exercise station 14, with seat 66 and leg extension frame 62 rotated to be substantially in line with leg extension member 60, can be placed in container 126 between upright member 28 and a side of container 126. In this manner, strength training device 10 can be packaged within container 126 in a substantially pre-assembled manner. Additionally, container 126 is generally the same size as containers used to package other strength training devices that are not pre-assembled. Furthermore, strength training device 10 can be reoriented between a packaged position and a use position without the use of tools.

As will be appreciated by one of ordinary skill in the art in view of the disclosure provided herein, the strength training system or device can be adapted to enable the cable and pulley system to link the resistance assembly to one or more exercise stations while the strength training system is in either the use position or in the packaged position. More particularly, the exercise stations can be adapted to remain linked to the resistance assembly by the cable and pulley system when the strength training system is in the packaged position or stored configuration. In this manner, the strength training system according to the present invention can be stored and shipped in an orientation where the cable and pulley system links one or more exercise stations to the resistance assembly thereby reducing the time required to set up the strength training system, while maintaining an appropriate package size for shipment.

In one embodiment of the invention, strength training system 10 can have an expanded footprint of about 48 inches or less to about 54 inches or more in depth by about 33 inches or less to about 39 inches or more in width, such as a depth of about 51 inches and a width of about 36 inches. In this embodiment, strength training system 10 can have a footprint while in the folded, stored, or shipping orientation of about 27 inches or less to about 33 inches or more in depth by about 8 inches or less to about 10 inches or more in width, such as a depth of about 30 inches and a width of about 9 inches. Such a configuration may result in a footprint of about 1836 square inches in the expanded or use orientation, such as shown in FIG. 1, and a footprint of about 270 square inches in the folded or collapsed orientation, such as shown in FIG. 8. Such a configuration may result in a reduction in the footprint of more than 80 percent, such as 85 percent or more.

In this embodiment, strength training system 10 can be adapted to be placed and shipped in a container having a height of about 78 inches, a width of about 9 inches and a depth of about 30 inches, while the strength training system 10 is substantially pre-assembled. The strength training system 10 can thereafter be removed from the container and expanded to a use orientation having a width of about 36 inches, a depth of about 51 inches and a height of about 76 inches. As such, the strength training system according to the present invention can have a width ratio of about 4:1 with respect to the use orientation and collapsed orientation, and can have a depth ratio of about 5:3 in the same respect.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A strength training device comprising:

a frame;

a resistance assembly coupled to said frame; and a press arm assembly comprising:

a press arm support pivotally secured to the frame and linked to the resistance assembly such that the resistance assembly resists rotation of the press arm support, wherein the press arm support has a first end and a second, wherein the first end of the press arm support is pivotally secured to the frame, wherein the press arm support comprises a first shaft;

a press arm pivotally secured to the second end of the press arm support;

an extension arm pivotally coupled to the press arm, wherein the extension arm is adapted to be engaged by a user to perform a strength training exercise; and a locking mechanism configured to selectively fix the press arm relative to the press arm support in one of a storage position and a use position, the press arm being closer to the frame when in the storage position than when in the use position, wherein the locking mechanism has a locked position and an unlocked position, wherein the locked position and unlocked position correspond to different positions along a length of the first shaft.

2. The strength training device of claim 1, wherein said strength training device is substantially more compact when said press are is in said storage position than when in said use position.

3. The strength training device of claim 1, further comprising a plurality of exercise stations linked to said resistance assembly.

4. The strength training device of claim 1, further comprising a shroud disposed around at least a portion of said resistance assembly, said shroud being made from a flexible, resilient material.

5. The strength training device of claim 1, wherein said resistance assembly comprises a cable and pulley system and a resistance device selected from the group consisting of one or more weight stacks, one or more resilient rods, a rotation-activated resistance mechanism, and a resistance mechanism having a pivoting arm and resistance member.

6. The strength training device of claim 1, wherein the press arm comprises a second shaft slidably coupled to the first shaft of the press arm support.

7. The strength training device of claim 6, wherein the locking mechanism comprises a biasing member engaging the first and second shafts, the locking mechanism further comprising a first cap secured to the first shaft and a second cap secured to the second shaft, wherein the biasing member contacts the first cap to engage the first shaft and biasing member contacts the second cap to engage the second shaft.

8. A strength training device comprising:

an upright member;

a resistance assembly coupled to the upright member; and a press arm assembly comprising:

a press arm support pivotally secured to the upright member and linked to the resistance assembly such that the resistance assembly resists rotation of the press arm support, wherein the press arm support comprises a first shaft, a press arm pivotally secured to the press arm support, wherein the press arm comprises a second shaft slidably engaging the first shaft of the press arm support, and a locking mechanism configured to selectively fix the press arm relative to the press arm support in one of a storage position and use a position, the press arm being closer to the upright member in the storage position, the locking mechanism configured such that the press arm can be moved from the use position to the storage position by (i) moving the press arm downwardly relative to the press arm support and (ii) rotating the press arm with respect to the press arm support, wherein the locking mechanism has a locked position and an unlocked position, wherein the locked position and unlocked position correspond to different positions along the first shaft, and wherein the press arm can move between the storage position and use position when the locking mechanism is in the unlocked position, and wherein the locking mechanism further comprises a biasing member engaging the first and second shafts urging the locking mechanism in the locked position.

9. The strength training device of claim 8, wherein the locking mechanism further comprising a pin engaging both the first and second shafts in the locked position and disengaged from one of the first and second shafts in the unlocked position.

10. The strength training device of claim 9, wherein the pin is disengaged from the first shaft in the unlocked position.

11. The strength training device of claim 8, wherein a portion of the second shaft is positioned within the first shaft.

12. The strength training device of claim 8, wherein the press arm support is pivotally secured to the upright member such that the press arm support is pivotable about a first axis and wherein the press arm is pivotally secured to the press arm support such that the press arm is pivotable about a second axis perpendicular to the first axis.

13. The strength training device of claim 8, wherein the press arm comprises an extension pivotally secured thereto and having a portion for gripping by a user.

14. The strength training device of claim 13, wherein the extension has a storage position and a use position, wherein the extension is closer to the press arm in the storage position of the extension than in the use position of the extension.

15. The strength training device of claim 8, wherein said resistance assembly is selected from the group consisting of one or more weight stacks, one or more resilient rods, a rotation-activated resistance device, and a resistance mechanism having a pivoting arm and resistance member.

16. The strength training device of claim 8, wherein said resistance assembly comprises a cable and pulley system and wherein the cable is selectively securable to the press arm support.

17. A strength training device comprising:

a frame;

a resistance assembly coupled to the frame; and a press arm assembly comprising:

a press arm support pivotally secured to the frame and linked to the resistance assembly such that the resistance assembly resists movement of the press arm support, wherein the press arm support comprises a first shaft, a press arm movably secured to the press arm support, wherein the press arm comprises a second shaft slidably coupled to the first shaft of the press arm support, and a locking mechanism configured to selectively fix the press arm relative to the press arm support in one of a storage position and use a position, wherein the locking mechanism comprises a biasing member engaging the first and second shafts, wherein the biasing member is adapted to bias the locking member in a locked position, wherein the locking mechanism is changed from a locked position to an unlocked position by movement of the second shaft along a length of the first shaft.

18. The strength training device of claim 17, further comprising a plurality of exercise stations linked to said resistance assembly.

19. The strength training device of claim 17, wherein said resistance assembly is selected from the group consisting of one or more weight stacks, one or more resilient rods, a rotation-activated resistance device, and a resistance mechanism having a pivoting arm and resistance member.

20. A strength training device comprising:

a frame;

a resistance assembly coupled to the frame; and a press arm assembly comprising:

a press arm support pivotally secured to the frame and linked to the resistance assembly such that the resistance assembly resists movement of the press arm support, wherein the press arm support comprises a first shaft, a press arm movably secured to the press arm support, wherein the press arm comprises a second shaft slidably coupled to the first shaft of the press arm support, and a locking mechanism configured to selectively fix the press arm relative to the press arm support in one of a storage position and use a position, wherein the locking mechanism comprises a biasing member engaging the first and second shafts, wherein the biasing member is adapted to bias the locking member in a locked position, wherein the locking mechanism comprises a first cap secured to the first shaft and second cap secured to the second shaft, wherein the biasing member contacts the first cap to engage the first shaft and biasing member contacts the second cap to engage the second shaft.

* * * * *

UNITED STATES PATENT AND TRADEMARK OFFICE

CERTIFICATE OF CORRECTION

PATENT NO. : 7,771,329 B2
APPLICATION NO. : 11/864270
DATED : August 10, 2010
INVENTOR(S) :Dalebout et al.

It is certified that error appears in the above-identified patent and that said Letters Patent is hereby corrected as shown below:

Column 1
Line 33, change “is” to --in--
Line 38, change “is” to --in--

Column 2
Line 25, change “an” to --a--

Column 4
Line 14, after “order” insert --to--
Line 42, change “28” to --22--

Column 6
Line 8, change “an press arm” to --a press arm--
Line 12, change “users” to --user’s--
Line 47, change “with out” to --without--

Column 13
Line 5, change “not” to --no--
Line 13, change “fastening members 32” to --fastening members 82--
Line 61, before “be placed” insert --can--

Column 15
Line 19, remove [are]
Line 59, change “use a” to --a use--

Column 16
Line 55, change “use a” to --a use--

Column 18
Line 3, change “use a” to --a use--

Signed and Sealed this
Eighth Day of March, 2011

David J. Kappos

David J. Kappos
*Director of the United States Patent and Trademark Office*